United States Patent [19]

Parker et al.

[11] Patent Number: 5,049,949

[45] Date of Patent: Sep. 17, 1991

[54] EXTENSION OF TRI-LEVEL XEROGRAPHY TO BLACK PLUS 2 COLORS

[75] Inventors: Delmer G. Parker; Jerome E. May, both of Rochester, N.Y.

[73] Assignee: Xerox Corporation, Stamford, Conn.

[21] Appl. No.: 373,127

[22] Filed: Jun. 29, 1989

[51] Int. Cl.[5] ..... G03G 15/01

[52] U.S. Cl. ..... 355/328; 430/42

[58] Field of Search ..... 355/328, 210; 430/42, 430/45, 902

[56] References Cited

U.S. PATENT DOCUMENTS

| | | | |
|---|---|---|---|
| 4,078,929 | 3/1978 | Sundlach | 96/1.2 |
| 4,403,848 | 9/1983 | Snelling | 355/327 |
| 4,562,130 | 12/1985 | Oka | 430/54 |
| 4,731,634 | 3/1988 | Stark | 355/328 |
| 4,771,314 | 9/1988 | Parker et al. | 355/328 |
| 4,847,655 | 7/1989 | Parker et al. | 355/328 X |
| 4,868,611 | 9/1989 | Germain | 355/328 |
| 4,920,024 | 4/1990 | Williams | 430/42 X |

*Primary Examiner*—Joan H. Pendegrass
*Assistant Examiner*—Robert Beatty

[57] ABSTRACT

Highlight color printing apparatus and method for forming one black and two color images. A tri-level image containing CAD and DAD image areas and a background area is formed. A second DAD image is formed by discharging the background area forming part of the tri-level image.

13 Claims, 3 Drawing Sheets

EXTENSION OF TRI-LEVEL XEROGRAPHY TO BLACK PLUS 2 COLORS

BACKGROUND OF THE INVENTION

This invention relates generally to highlight color imaging and more particularly to a printing apparatus and method for forming one black and two color images.

In the practice of conventional xerography, it is the general procedure to form electrostatic latent images on a charge retentive surface such as a photoconductive member by first uniformly charging the charge retentive surface. The charged area is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner by passing the photoreceptor past a single developer housing. The toner is generally a colored powder which adheres to the charge pattern by electrostatic attraction. The developed image is then fixed to the imaging surface or is transferred to a receiving substrate such as plain paper to which it is fixed by suitable fusing techniques.

In tri-level, highlight color imaging, unlike conventional xerography, not only are the charged (i.e., unexposed) areas developed with toner but the discharged (i.e., fully exposed) images are also developed. Thus, the charge retentive surface contains three voltage levels which correspond to two image areas and to a background voltage area. One of the image areas corresponds to non-exposed (i.e. charged) areas of the photoreceptor, as in the case of conventional xerography, while the other image areas correspond to fully exposed (i.e., discharged) areas of the photoreceptor.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided three, rather than two, ways as is the case in conventional xerography. The photoreceptor is charged, typically to 900 v. It is exposed imagewise, such that one image corresponding to charged image areas (which are subsequently developed by Charged-Area-Development, i.e. CAD) remains at or near the fully charged photoreceptor potential represented by $V_{cad}$ or $V_{ddp}$ as shown in FIG. 1*a*. The other images are formed by discharging the photoreceptor to its residual potential, i.e. $V_{dad}$ or $V_c$ (typically 100 v) which corresponds to discharged area images that are subsequently developed by Discharged-Area-Development (DAD). The background areas are formed by discharging the photoreceptor to reduce its potential to halfway between the $V_{cad}$ and $V_{dad}$ potentials, (typically 500 v) and is referred to as $V_{white}$ or $V_w$. The CAD developer is typically biased ($V_{bb}$, shown in FIG. 1*b*) about 100 v closer to $V_{cad}$ than $V_{white}$ is to $V_{cad}$, resulting in a $V_{bb}$ of about 600 volts, and the DAD developer system is biased ($V_{cb}$, shown in FIG. 1*b*) about 100 v closer to $V_{dad}$ than $V_{white}$ is to $V_{dad}$ resulting in a $V_{cb}$ of about 400 volts.

As developed, the composite tri-level image initially consists of both positive and negative toners. To enable conventional corona transfer, it is necessary to first convert the entire image to the same polarity. This must be done without overcharging the toner that already has the correct polarity for transfer. If the amount of charge on the toner becomes excessive, normal transfer will be impaired and the coulomb forces may cause toner disturbances in the developed image. On the other hand, if the toner whose polarity is being reversed is not charged sufficiently its transfer efficiency will be poor and the transferred image will be unsatisfactory.

The non-image, or white, or background potential of a conventional tri-level image is of extreme importance in the multi-level imaging contemplated by the present invention. For example, it can be used to form a second DAD image. The exposure step for applying the second color image in a DAD mode, in accordance with the present invention, is done with an LED, a vacuum fluorescent (VF), or a liquid crystal (LX) array. These arrays are typically more compact than laser scanners, but suffer from the drawback of being less uniform in their exposure characteristics than the laser scanner. Thus, these exposure systems lead to wide variations in the background potential, which subsequently require large cleaning fields to suppress background development. As the total potential available for development of the image is set by characteristics of the photoreceptor, the requirements for large cleaning fields reduce the potential available for the latent image.

An additional problem with using more than one exposure step is the registration of one image with respect to another on the same printed page. Systems which use one exposure step for each color will have images displaced from the ideal position due to variations in photoreceptor velocity between one image step and the next. An example of such a system is disclosed in U.S. Pat. No. 4,403,848 granted to Snelling on Sept. 13, 1983. As disclosed therein the production of multiple-color images is effected by means of exposing and subsequently developing a multiplicity of DAD images prior to transfer to paper. Each image requires an exposure step.

Another example of a system requiring one exposure step for each image is disclosed in U.S. Pat. No. 4,562,130 granted to Oka on Dec. 31, 1985. Oka discloses the production of a two-color image derived from a positive optical image and an electronic image. Due to the inexactness of the background potential after the first exposure, a precision recharging mechanism is required in order to level the potential in the non-image area of the photoreceptor prior to exposure by the second electronic imaging source. Again, as in the case of Snelling's device, one exposure step is required for each color on the printed page. This latter point is significant, in that, the more exposure steps used the more difficult it is to effect acceptable image registration.

In addition to the image registration problem, imaging systems which employ multiple exposure steps require that the electronic form of the image be delayed a period of time determined by the distance between exposure stations and the velocity of the photoreceptor. In electronic printing systems which have different information on every single page, the precise coordination of these delays and the buffering of electronic information between exposure steps in an extremely difficult task.

A multiple color imaging system which do not require an exposure step for each image is known. For example, highlight color imaging as taught by Stark in U.S. Pat. No. 4,731,634 issued Mar. 15, 1988 uses a single exposure to create a four level composite latent image. Because there is only one exposure, the composite parts of the latent image are in perfect registration. The image therein is formed using a quad level raster output scanner. The disadvantage of the quad imaging approach is that the development contrast available for each color is less than $V_0/4$. Moreover, two of the four images are formed by one of the CAD and one of the DAD images being over-printed by its companion CAD or DAD color.

BRIEF SUMMARY OF THE INVENTION

The present invention extends the tri-level imaging of Gundlach to enable creating images containing one black and two color images with, unlike the prior art devices noted above, perfect image registration between black and at least one of the color images. Also, the images of the present invention are created using substantially the full $V_{0/2}$ contrast voltage associated with tri-level imaging as taught by Gundlach and others.

In accordance with the present invention, the charge retentive surface, preferably a photoreceptor, is uniformly charged to a voltage Equal to $V_0$. Then a single laser ROS (Raster Output Scanner) exposure is employed to create a conventional tri-level latent image comprising a first color or DAD image represented by voltage level $V_{c1}$ (see FIG. 3*a*) and a charged area image represented by voltage level $V_{bk}$. The first color image is developed (FIG. 3*b*) using Discharged Area Development (DAD). Following this step, a second DAD image (FIG. 3*c*), representing a second color is superimposed on the the original tri-level latent image with a Light Emitting Diode (LED) array. This image is then DAD developed (FIG. 3*d*) with the second color developer. The second DAD image could also be formed using a vacuum fluorescent (VF), or liquid crystal (LX) array.

After this step, a third or CAD development housing develops the charged areas of the charge retentive surface with a black toner (see FIG. 3*e*). The composite, developed image is pre-transfer charged to convert the entire image to a common polarity, and the image is transferred to paper.

Thus, the charged areas, $V_0$, of the tri-level latent image represent black portions of the image that will subsequently be Charged Area Developed (CAD), and the discharged areas, $V_{residual}$ ($V_{c1}$ and $V_{c2}$) represent the first and second colors which will subsequently be developed using Discharged Area Development (DAD). The "white" or background reference potential $V_{wht}$ is at a voltage level $V_{0/2}$, and is not developed.

DESCRIPTION OF THE DRAWINGS

FIGS. 3*a* through 3*e* graphically represent an imaging process for creating one black plus two color images utilizing three development steps and only two exposure steps wherein:

FIG. 3*a* illustrates a charge retentive surface after a first exposure step;

FIG. 3*b* illustrates a charge retentive surface after development of a first DAD image;

FIG. 3*c* illustrates a charge retentive surface after a second exposure step;

FIG. 3*d* illustrates a charge retentive surface after development of a second DAD image; and FIG. 3*e* illustrates a charge retentive surface after development of a CAD image.

DETAILED DESCRIPTION OF THE PREFERRED EMBODIMENT OF THE INVENTION

Figure 1A:
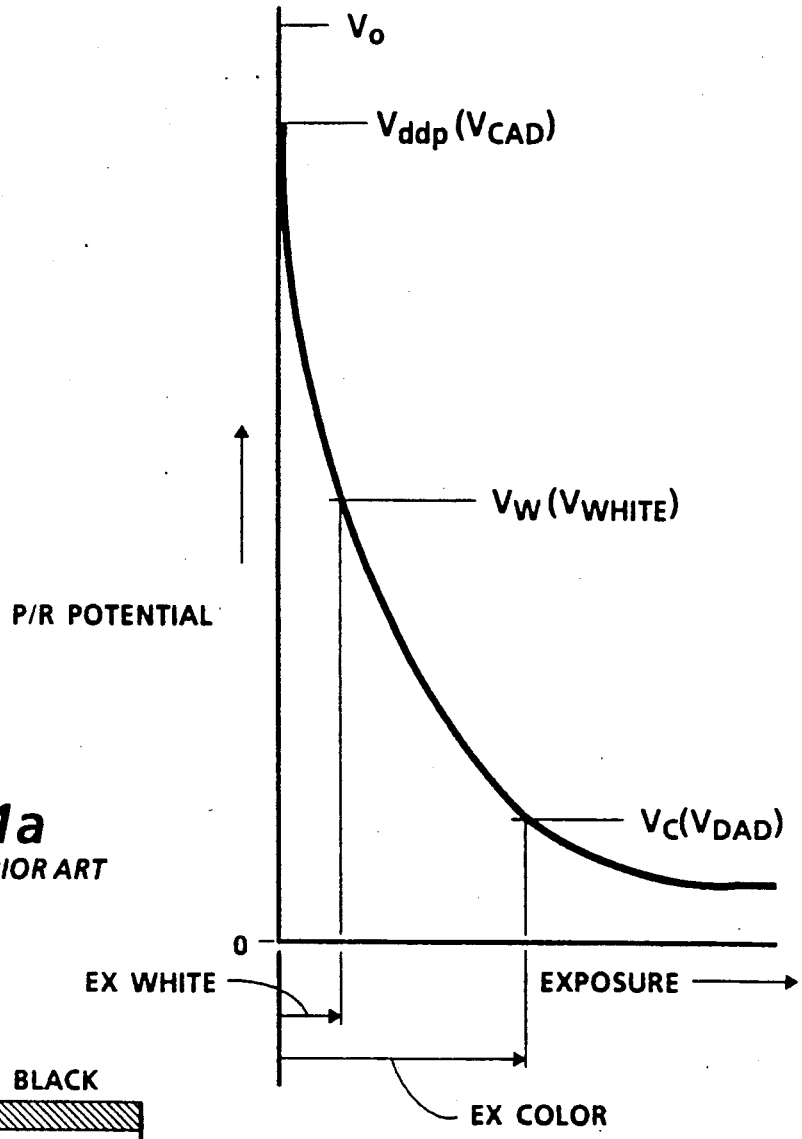
FIG. 1a PRIOR ART
FIG. 1*a* is a plot of photoreceptor potential versus exposure illustrating a tri-level electrostatic latent image.
Figure 1B:
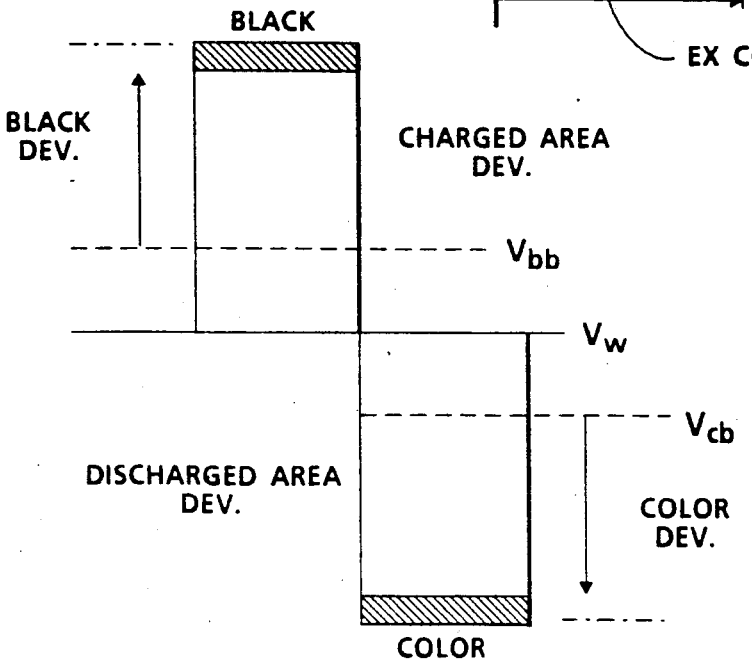
FIG. 1b PRIOR ART
FIG. 1*b* is a plot of photoreceptor potential illustrating single-pass, highlight color latent image characteristics.
Figure 2:
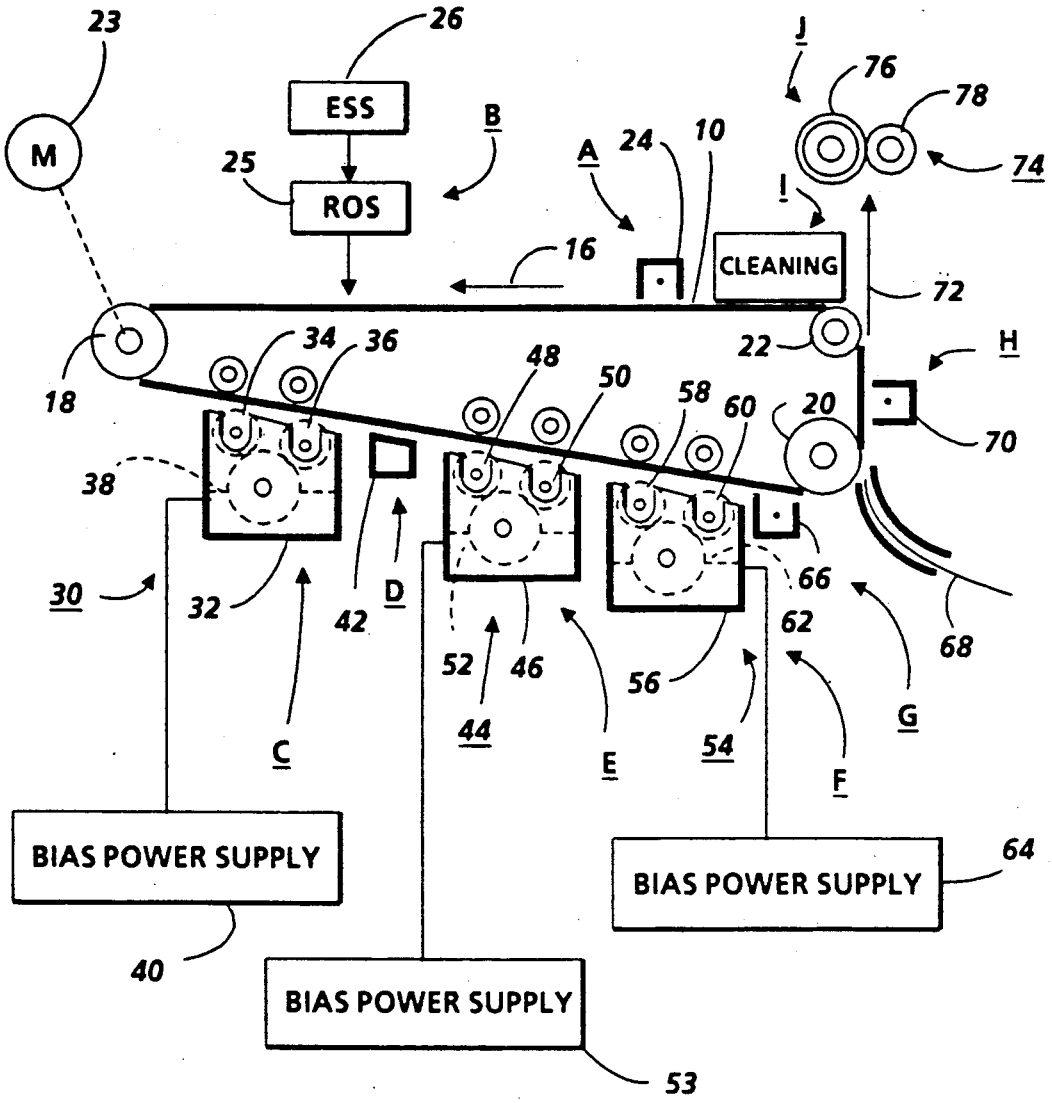
FIG. 2 is schematic illustration of a printing apparatus incorporating the inventive features of the invention.

As shown in FIG. 2, a printing machine incorporating the invention may utilize a charge retentive member in the form of a photoconductive belt 10 consisting of a photoconductive surface and an electrically conductive, light transmissive substrate and mounted for movement past a charging station A, a first exposure station B, a first development station C, a second exposure station D, a second development station E, a third development station F, a pre-transfer charging station G, a transfer station H, and a cleaning station I. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges th belt 10 to a selectively high uniform positive or negative potential, $V_0$. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based output scanning device 25 which causes the charge retentive surface to remain charged or to be discharged in accordance with the output from the scanning device. Preferably the scanning device is a three-level laser Raster Output Scanner (ROS). An Electronic SubSystem (ESS) 26 converts a previously stored image into the appropriate control signals for the ROS in an imagewise fashion. The resulting photoreceptor contains both charged-area (CAD) images designated and discharged-area images (DAD) designated as well as background areas designated.

The photoreceptor, which is initially charged to a voltage $V_0$, undergoes dark decay to a level $V_{bk}$ equal to about −900 volts. When exposed at the exposure station B it is discharged to $V_{c1}$ equal to approximately −100 volts in a first highlight (i.e. color other than black) color parts of the image. See FIG. 3*a*. The photoreceptor is also discharged to $V_{wht}$ equal to −500 volts imagewise in the background (white) areas and in the inter-document area. After passing through the exposure station B, the photoreceptor contains charged areas and discharged areas which corresponding to CAD and DAD latent images.

At development station C, a developer apparatus, indicated generally by the reference numeral 30 advances developer material into contact with the DAD electrostatic latent image, $V_{c1}$. The developer apparatus 30 comprises a housing 32 containing a pair of magnetic brush rollers 34 and 36. The rollers advance developer material 38 into contact with the photoreceptor for developing the discharged-area images. The developer material 38 which preferably has a negative polarity contains, for example, red toner mixed with carrier beads. Electrical biasing is accomplished via power supply 40 electrically connected to developer apparatus 32. A DC bias of approximately −400 volts is applied to the rollers 34 and 36 via the power supply 40.

At the second exposure station D, a Light Emitting Diode (LED) array 42 is provided for forming a second DAD image. The second DAD image is effected by discharging the background areas $V_{wht}$ formed during the first exposure. A vacuum fluorescent (VF) or liquid crystal (LX) array could be employed in lieu of the LED array 42.

A second developer apparatus 44 disposed at the development station E comprises a housing 46 containing a pair of magnetic brush rolls 48 and 50. The rolls advance developer material 52 into contact with the photoreceptor for developing the discharged-area images formed by the LED array 42. The developer material 52 which preferably has a negative polarity comprises, for example, green toner mixed with carrier beads. Electrical biasing is accomplished via power supply 53 electrically connected to developer apparatus 44. A DC bias of approximately −400 volts is applied to the rollers 48 and 50 via the power supply 53. While red and green toners have been mentioned for use in developing the two DAD images, other colors such as blue, brown, etc. may be used in any suitable combination desired. Preferably, the bias voltage applied to the developer apparatus 44 is set to the neutralization potential of the first DAD image in lieu of the −400 volts specified above.

A third developer apparatus 54 disposed at the development station F comprises a housing 56 containing a pair of magnetic brush rolls 58 and 60. The rolls advance developer material 62 into contact with the photoreceptor for developing the charged-area images formed at the first exposure station B. Developer material 62 which preferably has a positive polarity comprises black toner mixed with carrier beads for developing the discharged-area images. Electrical biasing is accomplished via power supply 64 electrically connected to developer apparatus 54. A DC bias of approximately −600 volts is applied to the rollers 58 and 60 via the power supply 64.

Figure 3A:
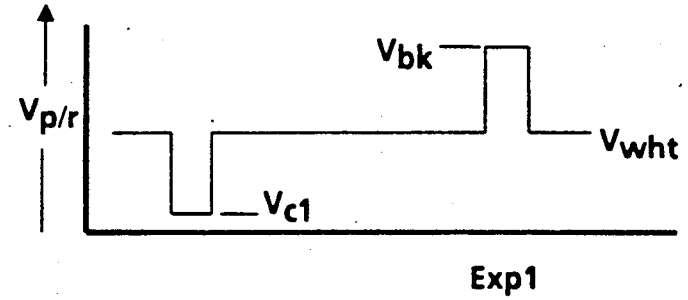
Figure 3B:
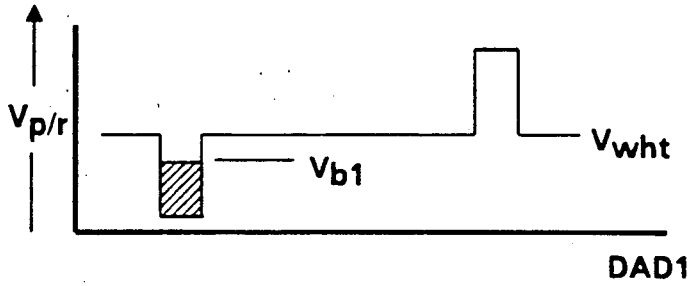
Figure 3C:
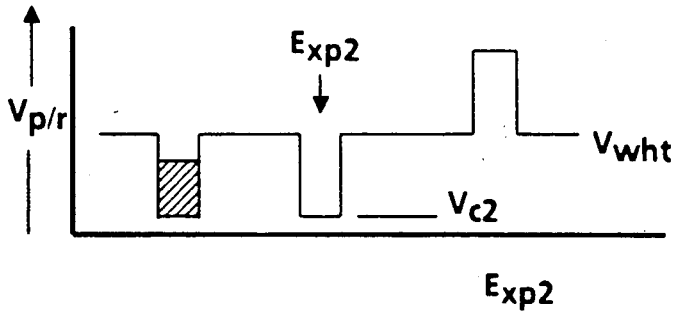
Figure 3D:
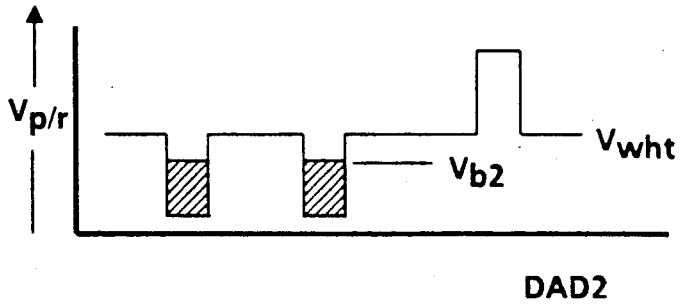
Figure 3E:
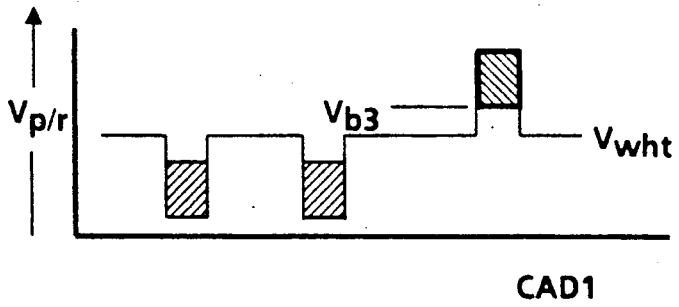

The imaging process of the present invention will now be described with reference to FIGS. 3*a* through 3*e*. As disclosed therein (FIG. 3*e*) the final image comprises black plus two colors. FIG. 3*a* illustrates a traditional DAD/CAD tri-level image created by the ROS exposure apparatus 25. The precision of the ROS is used to set photoreceptor white or background potential, $v_{wht}$ during the imaging carried out at the exposure station B. Because the laser ROS 25 writes two images simultaneously (both the CAD, $V_{bk}$ image and one DAD, $V_{c1}$ image), the registration between the CAD and first DAD image is immune to registration errors due to photoreceptor velocity variation. The DA portion of the tri-level image represented by voltage levl $V_{c1}$ comprises one of two colored images created during the imaging process. The CAD portion of the tri-level image represented by voltage level $V_{bk}$ comprises the black image.

Subsequent to the formation of the tri-level image the DAD image represented by $V_{c1}$ is developed (FIG. 3*b*) using a first color (red) toner contained in developer housing 32. The developer housing 32 is electrically biased to voltage level $V_{b1}$. Development of the first color image is immediately followed by a second exposure step (FIG. 3*c*) at the second exposure station D. The LED array 42 is utilized to discharge or otherwise modify $V_{wht}$ or the background potential down to the residual photoreceptor potential (close to zero) in order to form a second DAD image represented by voltage level $V_{c2}$. Alternatively, a vacuum fluorescent (VF), or liquid crystal (LX) array may be used in lieu of the LED array 42. The second DAD image represented by $V_{c2}$ is then developed (FIG. 3*d*) by a second color toner (green) contained in the developer housing 46 which is electrically biased at a suitable voltage level $V_{b2}$. Lastly, the CAD image, $V_{bk}$ is developed (FIG. 3*e*) using black toner contained in the developer housing 56 which is electrically biased to a suitable voltage $V_{b3}$.

The order in which the images are formed in FIGS. 3*a* through 3*e* may be reversed without departing from the spirit and scope of the invention. For example, the tri-level latent image could be created followed by a CAD development, a DAD development, a second exposure to create a second DAD image, and finally a second DAD development. In principle, more than two DAd images could be created by tandem DAD exposure/DAD development steps to facilitate multiple colors on a page with one transfer.

As may be appreciated our method could be used in a two cycle, single transfer mode to produce black plus two color prints. In this case, on the first cycle, the the laser ROS would be used to create the CAD/DAD tri-level image and the DAD image would be developed. On the second cycle the same laser ROS would create the second DAD image which would be developed, and followed by the CAD development, pre-transfer charging, and transfer to the receiving sheet.

Because the composite image developed on the photoreceptor consists of both positive and negative toner, a typically positive pre-transfer corona discharge member 66 disposed at pre-transfer charging station G is provided to condition the toner for effective transfer to a substrate using positive corona dishcarge. The pre-transfer corona discharge member is preferably an ac corona device biased with a dc voltage to operate in a field sensitive mode and to perform tri-level xerography pre-transfer charging in a way that selectively adds more charge (or at least comparable charge) to the part of composite tri-level image that must have its polarity reversed compared to elsewhere. This charge discrimination is enhanced by discharging the photoreceptor carrying the composite developed latent image with light (not shown) before the pre-transfer charging begins. Furthermore, flooding the photoreceptor with light coincident with the pre-transfer charging minimizes the tendency to overcharge portions of the image which are already at the correct polarity.

A sheet of support material 68 is moved into contact with the toner image at transfer station H. The sheet of support material is advanced to transfer station H by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station H.

Transfer station H includes a corona generating device 70 which sprays ions of a suitable polarity onto the backside of sheet 68. This attracts the charged toner powder images from the belt 10 to sheet 68. After transfer, the sheet continues to move, in the direction of arrow 72, onto a conveyor (not shown) which advances the sheet to fusing station J.

Fusing station J includes a fuser assembly, indicated generally by the reference numeral 74, which permanently affixes the transferred powder image to sheet 68. Preferably, fuser assembly 74 comprises a heated fuser roller 76 and a backup roller 78. Sheet 68 passes between fuser roller 76 and backup roller 78 with the toner powder image contacting fuser roller 76. In this manner, the toner powder image is permanently affixed to sheet 68. After fusing, a chute, not shown, guides the advancing sheet 68 to a catch tray, also not shown, for subsequent removal from the printing machine by the operator.

After the sheet of support material is separted from photoconductive surface of belt 10, the residual toner particles carried by the non-image areas on the photoconductive surface are removed therefrom. These particles are removed at cleaning station I. A magnetic brush cleaner housing is disposed at the cleaner station I. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush. Other cleaning systems, such as fur brush or blade, are also suitable.

Subsequent to cleaning, a discharge lamp (not shown) floods the photoconductive surface with light to dissipate any residual electrostatic charge remaining prior to the charging thereof for the successive imaging cycle.

What is claimed is:

1. A method of creating toner images on a charge retentive surface, said method including the steps of:
- uniformly charging said charge retentive surface;
- exposing said uniformly charged surface to form a tri-level latent image comprising a charged-area image, a discharged-area image and a background area;
- using toner particles, developing one of said images;
- modifying said background area to form another image;
- using toner particles, developing said another image;
- developing the other of said images.

2. The method according to claim 1 wherein the step of developing one of said images comprises developing the discharged-area image of said tri-level latent image.

3. The method according to claim 1 wherein said step of modifying comprises discharging said background area to form another image.

4. The method according to claim 3 wherein the step of developing one of said images comprises developing the discharged-area image of said tri-level latent image.

5. The method according to claim 4 wherein the step of developing said other of said images comprises developing said charge-area image.

6. Apparatus for creating multiple color images, said apparatus comprising:
- a charge retentive surface;
- means for uniformly charging said charge retentive surface;
- exposure means for forming a tri-level image on said charge retentive surface, said tri-level image including at least one DAD image, at least one CAD image and background areas;
- means for developing one of said images;
- means for modifying said background areas for forming another image;
- means for developing said another image; and
- means for developing the other of said images.

7. Apparatus according to claim 6 wherein said means for developiong one of said images develops said DAD image with a toner of a first color.

8. Apparatus according to claim 7 wherein said means for modifying said background areas comprises means for discharging said background areas in accordance with an image to be formed.

9. Apparatus according to claim 8 wherein said means for developing said another image comprises a developer housing containing toner which is a different color from said toner used to develop said DAD image.

10. Apparatus according to claim 9 wherein said means for developing said other of said images comprises a developer housing containing black toner.

11. Apparatus according to claim 10 wherein said tri-level image forming means comprises means for developing one of said images, means for modifying said background areas, means for developing said another image and said means for developing the other of said images are arranged about said charge retentive surface such that a portion of said charge retentive surface is moved therepast in that order.

12. A method of creating toner images on a charge retentive surface, said method including the steps of:
- uniformly charging said charge retentive surface;
- exposing said uniformly charged surface to form a tri-level latent image comprising a charged-area image, a discharged-area image and a background area;
- using toner particles, developing one of said images;

modifying said background area to the same charge level as said discharged-area image to form another image;

using toner particles, developing said another image; and developing the other of said images.

13. Apparatus for creating multiple color images, said apparatus comprising:

a charge retentive surface;

means for uniformly charging said charge retentive surface;

exposure means for forming a tri-level image on said charge retentive surface, said tri-level image including at least one DAD image, at least one CAD image and background areas;

means for developing one of said images;

means for modifying at least one of said background areas to the same charge level as said discharged-area image for forming another image;

means for developing said another image; and means for developing the other of said images.

* * * * *